US005870062A

United States Patent [19]

Cox

[11] Patent Number: 5,870,062

[45] **Date of Patent: *Feb. 9, 1999**

[54] MICROWAVE ANTENNA FEED STRUCTURE

[75] Inventor: Gary A. Cox, Melbourne, Australia

[73] Assignee: Andrew Corporation, Orland Park, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 671,060

[22] Filed: Jun. 27, 1996

[51] Int. Cl.[6] ..... H01Q 13/02

[52] U.S. Cl. ..... 343/781 R; 343/786; 333/239; 333/255

[58] Field of Search ..... 343/781 R, 840, 343/786, 915, 916; 333/239, 248, 254, 255; H01Q 13/02, 13/06

[56] References Cited

U.S. PATENT DOCUMENTS

| | | | |
|---|---|---|---|
| 2,775,420 | 3/1956 | Koch | 343/840 |
| 2,945,233 | 7/1960 | Wild et al. | 343/840 |
| 3,216,018 | 11/1965 | Kay | 343/781 R |
| 3,712,644 | 1/1973 | Hara et al. | 333/254 |
| 4,263,599 | 4/1981 | Bielli et al. | 343/781 R |
| 4,608,571 | 8/1986 | Luly | 343/915 |
| 4,786,913 | 11/1988 | Barendregt et al. | 333/248 |
| 4,875,027 | 10/1989 | Spinner | 333/254 |
| 4,920,351 | 4/1990 | Bartlett et al. | 343/786 |
| 4,929,962 | 5/1990 | Begout et al. | 343/786 |

*Primary Examiner*—Michael C. Wimer
*Attorney, Agent, or Firm*—Arnold, White & Durkee

[57] ABSTRACT

A feed structure for transmitting or receiving microwave energy to or from a reflector includes a waveguide having an input section, intermediate section, and output section. The waveguide has an inner surface of generally rectangular cross section and an outer surface of generally circular cross section. The outer surface includes unique opposing convex surfaces which enables the waveguide to be bent with minimal resulting deformation of the internal rectangular surface. At least one locating surface is provided on the outer surface of the waveguide for determining the orientation of the waveguide. The input section of the waveguide has a threaded cylindrical surface adapted to be connected to a hub having a threaded interior bore which is connected to the reflector. A feed horn integral with the output section of the waveguide and having a circular output aperture is formed by machining the inner surface of the waveguide into a rectangular to circular transition. The intermediate section of the waveguide is curved so that the output aperture of the horn is directed toward the reflecting surface of the reflector, enabling waves transmitted from the aperture toward the reflecting surface to be reflected into space in the form of plane waves.

22 Claims, 4 Drawing Sheets

MICROWAVE ANTENNA FEED STRUCTURE

FIELD OF THE INVENTION

The present invention relates generally to microwave antennas and waveguides and, more particularly, to the use of a novel feed structure for a microwave reflector antenna containing a waveguide and a feed horn integral with the waveguide.

BACKGROUND OF THE INVENTION

A parabolic or other suitably shaped reflector is a well known device for the transmission or reception of electromagnetic energy. When employed as a transmitting antenna, a feed horn located at the focus of the reflector directs microwave energy toward the reflecting surface of the reflector. The surface of the reflector then serves to reflect the waves from the feed horn into space in the form of plane waves. Conversely, when employed as a receiving antenna, a microwave reflector reflects plane waves from space toward a feed horn located at the focus of the reflector. Whether operating in the mode of a transmitter or receiver, the feed horn is typically connected by means of a waveguide to a transmission line originating behind the surface of the reflector. The waveguide is appropriately curved so as to minimize interference with microwave energy passed between the feed horn and the reflector. Typically, the step of bending the waveguide in the prior art requires the use of an internal mandrill to avoid deforming the interior cross section of the waveguide. Nevertheless, bending of the waveguide creates imperfections in the interior cross section of the waveguide which contribute to energy losses in the reflector system. Energy losses may also be caused by imperfections in the waveguide, feed horn or reflector. Prior art feed horn assemblies further contribute to energy losses in that their waveguide and feed horn frequently consist of multiple components which are joined together by a brazing process resulting in an imperfect interface between the components. As a result of the above imperfections and associated energy losses, feed systems known in the art must commonly undergo an extensive tuning process before they may be operated efficiently.

The present invention is directed to overcoming or at least reducing the effects of one or more of the problems set forth above.

SUMMARY OF THE INVENTION

In accordance with one aspect of the present invention, there is provided a microwave antenna consisting of a reflector and a feed structure for transmitting or receiving microwave energy to or from the reflector. The feed structure is comprised of a waveguide and a feed horn integral with an output end of the waveguide. The waveguide includes an inner surface having a rectangular cross section and an outer surface having a generally circular cross section.

In accordance with another aspect of the present invention, there is provided a method of manufacturing a feed structure for a microwave reflector antenna. The method includes a first step of forming a metal waveguide with an inner surface having a rectangular cross section and an outer surface having a generally circular cross section adapted to be bent with minimal resulting deformation of the rectangular inner surface of the waveguide. A externally threaded cylindrical input section is formed at one end of the waveguide which is adapted to be connected to an internally threaded hub connected to a reflector. A feed horn with a circular output aperture is then formed at an output end of the waveguide by machining a rectangular to circular transition within the inner surface of an output section of the waveguide. Finally, the metal waveguide is bent into a curved shape so that the feed horn is adapted to be directed toward the reflecting surface of a microwave reflector. The bending step is accomplished with minimal deformation of the rectangular inner surface of the waveguide.

BRIEF DESCRIPTION OF THE DRAWINGS

The foregoing and other advantages of the invention will become apparent upon reading the following detailed description and upon reference to the drawings in which.

Figure 1A:
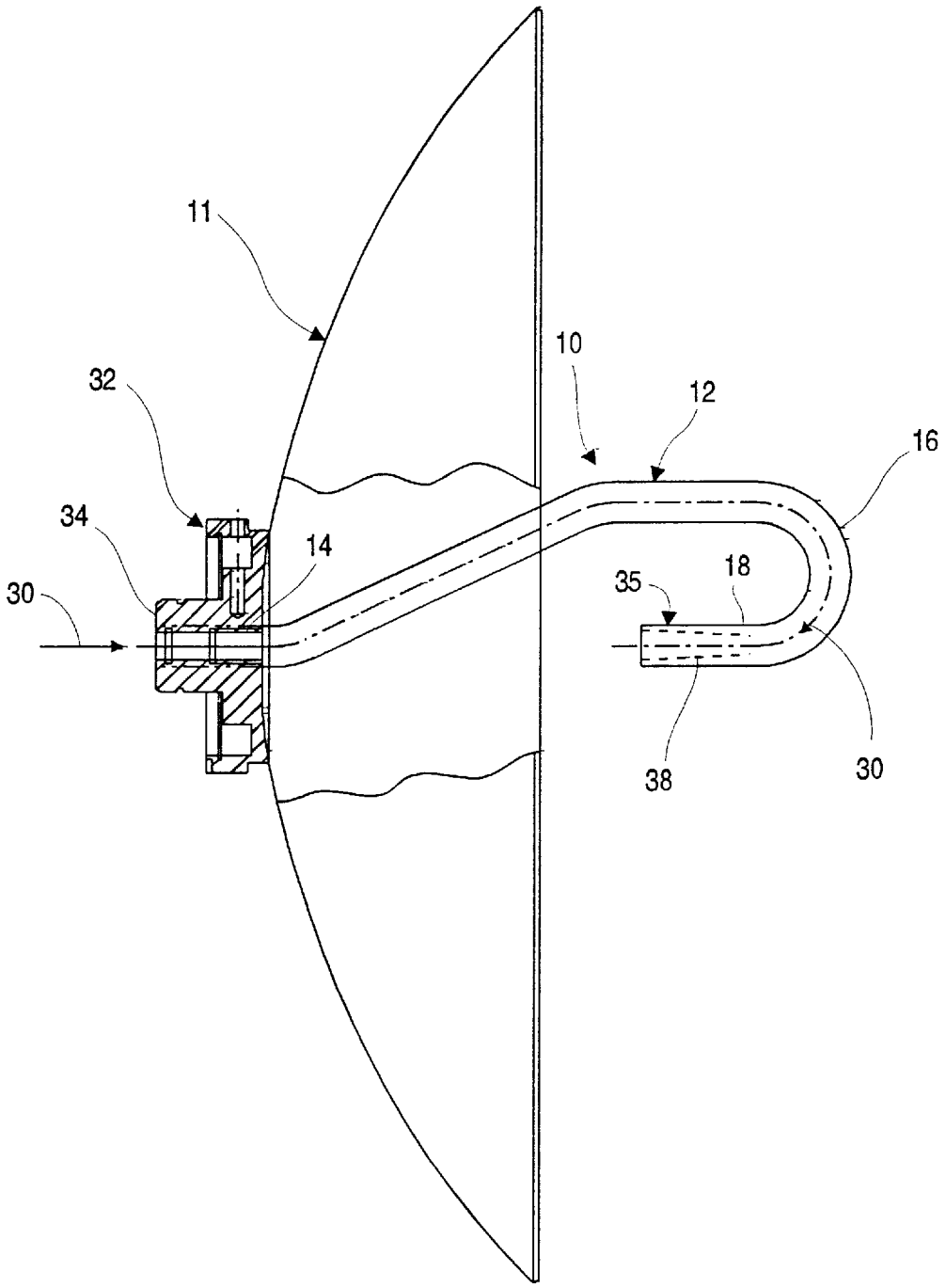
FIG. 1*a* is a sectional view of an assembled feed structure for use with a microwave reflector embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Figure 1B:
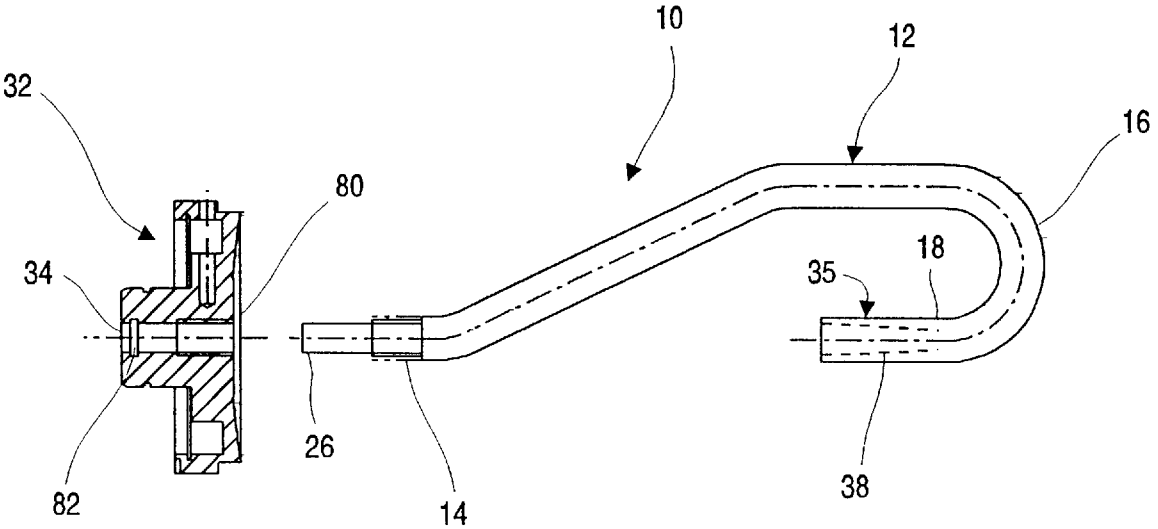
FIG. 1*b* is an exploded sectional view of the feed structure of FIG. 1*a;*
Figure 2:
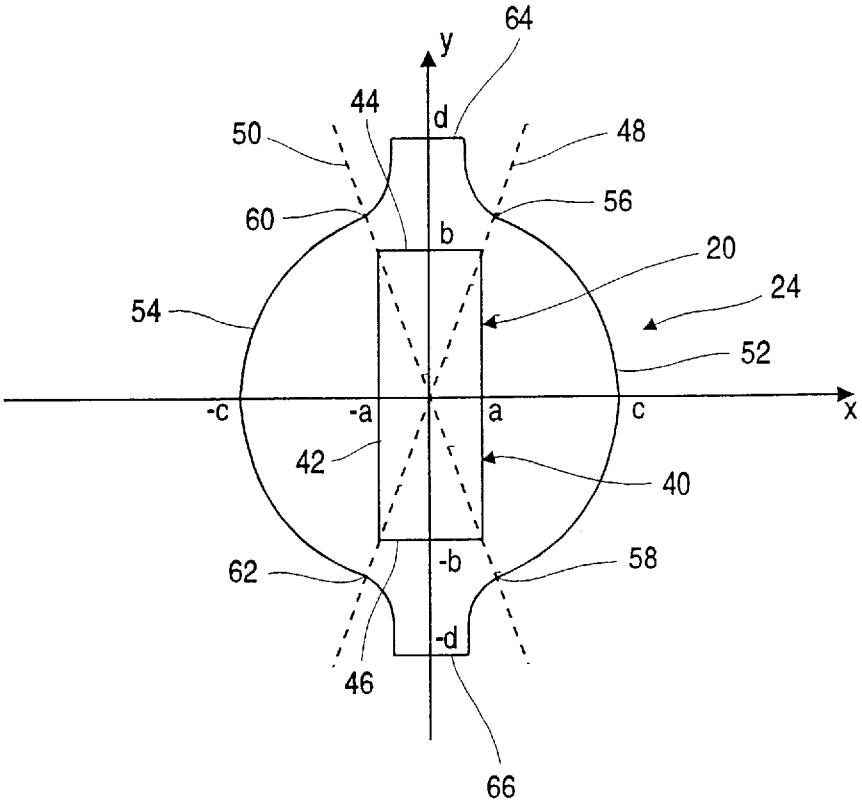
FIG. 2 is a sectional view illustrating the rectangular inner surface and generally circular outer surface of the waveguide portion of the feed structure embodying the present invention.

Turning now to the drawings and referring initially to FIG. 1*a* and 1*b*, a feed structure embodying the present invention is illustrated and generally designated by a reference numeral 10. Although the following description of the operation of the feed structure 10 will assume that the feed structure 10 is being used in a transmission mode for delivering microwave energy to a reflector 11, it should be understood that the feed structure 10 may also be used in a receive mode for receiving microwave energy from a refector 11. The feed structure 10 is constructed of a waveguide 12 having an input section 14, intermediate section 16, and output end 18. As shown in FIG. 2, the waveguide 12 has an inner surface 20 with a generally rectangular cross section. The waveguide 12 further includes an outer surface 24 with a generally circular cross section which is designed to be bent with minimal resulting deformation of the rectangular inner surface 20 of the waveguide 12. Although the waveguide 12 shown in FIG. 2 has a rectangular inner surface 20, it should be appreciated that the internal dimensions of waveguide 12 may be provided in any configuration capable of supporting the propagation of electromagnetic energy. According to one embodiment of the invention, the waveguide 12 is made of aluminum, but again it should be appreciated that the waveguide 12 may be made of any other material capable of supporting the propagation of electromagnetic energy. Referring again to FIG. 1*a* and 1*b*, the input section 14 of the waveguide 12 has an input end 26 which is adapted to be connected to an external transmission line (not shown). After connecting to an external transmission line, microwave energy may be propagated through the waveguide 12 in the direction of the arrows 30 when in the transmission mode, passing through an opening 34 of a hub 32 and continuing along the waveguide 12 toward the intermediate section 16 and output end 18.

The hub 32, which may be made of aluminum, is provided with an internally threaded bore 80 which corresponds with a threaded cylindrical input section 14 of waveguide 12. The input end 26 of the waveguide 12 is inserted into the threaded bore and rotated so that the input section 14 of the waveguide 12 becomes threadedly engaged within the threaded bore 80 of the hub 32 and extends at least partially through the length of the hub 32. The relative position of the waveguide 12 to the reflector 11 can thereby be adjusted by the user to optimize performance of the antenna by simply rotating the input section 14 of the waveguide 12 a desired distance into the threaded bore 80. This feature provides a significant improvement over antenna feed structures known in the art because it reduces the need to subsequently tune the antenna. Once the optimal position is found, a conventional fastener may be used to fix the rotational position of the input section 14 of the waveguide 12 relative to the hub 32. The input end 26 may extend all the way through the hub 32 such that it protrudes out of the opening 34 at the rear of the hub, in which case the input end 26 may be machined off so as to provide a consistent electrical interface. An 0-ring (not shown) may be provided within a retaining region 82 for enhancing the seal of the input section 14 within the hub 32.

Figure 1C:
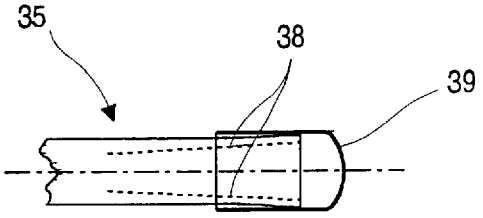
FIG. 1*c* is a typical section view of the feed horn portion of the feed structure of FIG. 1*a;*

At the output end 18 of the waveguide 12, there is provided a feed horn 35 integral with the output end 18 of the waveguide 12 having an inner surface generally designated by dashed lines 38. Because the feed horn 35 is integral with the waveguide 12, imperfections in the interface between the waveguide 12 and the feed horn 35 are minimized. As the horn geometry may be machined accurately, no brazing or heating is required and the need for tuning is minimized. The intermediate section 16 is bent such that the output of the feed horn 35 is located approximately at the focus of the reflector 11 and directed toward its reflecting surface 36. As portrayed in FIG. 1c, a window 39 is placed about the output of the feed horn 35 in order to protect the feed horn 35 and waveguide 12 from moisture and other environmental elements. Bending of the intermediate section 16 minimizes distortion of the rectangular inner surface 20 of the waveguide 12 and minimizes the need for using an internal mandrill, thereby providing a significant advantage over waveguides known in the art.

Referring again to FIG. 2, the rectangular inner surface 20 and exterior surface 24 of the waveguide 12 according to one embodiment of the invention will be described in greater detail. A Cartesian coordinate system centered at the interior of the waveguide 12 is included to facilitate the foregoing description. The rectangular inner surface 20 of the waveguide 12 is formed between two parallel faces 40 and 42 which intersect upper and lower faces 44 and 46 oriented at right angles to the faces 40 and 42. As illustrated in FIG. 2, the faces 40 and 42 have a cross-sectional length 2*b* and the shorter faces 44 and 46 have a cross-sectional length 2*a*. With reference to the Cartesian coordinate system, face 40 intersects the x axis at (a, 0) and intersects shorter faces 44 and 46 at (a, b) and (a, −b), respectively. Face 42 intersects the x axis at (−a, 0) and intersects shorter faces 44 and 46 at (−a, b) and (−a, −b), respectively. Faces 44 and 46 intersect the y axis at (0, b) and (0, −b), respectively. The exterior surface 24 of the waveguide 12 has a generally circular cross-sectional shape defined by two opposing convex surfaces 52 and 54 oriented outside faces 40 and 42 and intersecting the x axis at (c, 0) and (−c, 0). Dashed lines 48 and 50 extending through the corners of the rectangular interior surface 20 intersect the opposing convex surfaces 52 and 54 at points 56, 58, 60 and 62. The wall thickness of the waveguide 12 defined by the distance between the exterior surface 24 and the rectangular inner surface 20 of the waveguide 12 is less at points 56, 58, 60 and 62 than it is at any other point along the exterior surface 24. This enables the waveguide 12 to be bent with minimal resulting deformation of the rectangular inner surface 20 of the waveguide 12. The exterior surface 24 of the waveguide 12 further includes opposing locating surfaces 64 and 66 which intersect the opposing convex surfaces 52 and 54. The locating surfaces 64 and 66 are parallel flat surfaces which intersect the y axis at points (0, d) and (0, −d) respectively. The locating surfaces 64 and 66 are parallel to the short faces 44 and 46 of the rectangular inner surface 20 of the waveguide 12 so that a user may ascertain the orientation of the waveguide 12 by viewing its exterior surface 24.

Figure 3:
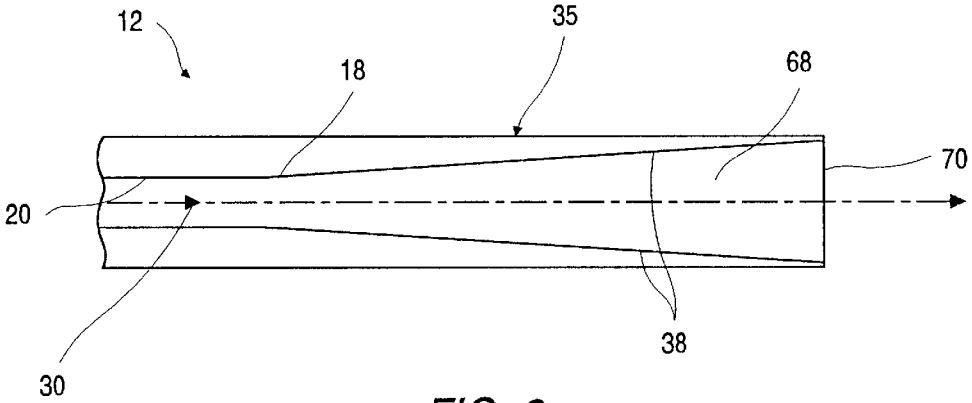
FIG. 3 is a sectional view of one feed horn for use in the feed structure of FIG. 1*a; and*

Turning now to FIG. 3, there is illustrated a feed horn 35 according to one embodiment of the present invention. A feed horn by definition is a transition section of a feed assembly where, in the transmission mode, the electrical energy emerges from the waveguide to free space. Conversely, in the receive mode, a feed horn serves to transition electrical energy from free space to the waveguide. Accordingly, although the following description will refer to operation of the feed horn 35 in a transmission mode for delivering microwave energy to a reflector, it should be understood that the feed horn 35 may also be operated in a receive mode for receiving microwave energy from a reflector. As waves propagate through the waveguide 12 in the direction of the arrows 30, they encounter the feed horn 35 which is integral to the output end 18 of the waveguide 12. The feed horn 35 is manufactured by machining the rectangular inner surface 20 of an output section of waveguide 12 to form an inner area 68 defined within the boundaries of tapered walls 38. The inner area 68 of the feed horn 35 flares outwardly from the output end 18 of the waveguide 12 and terminates at a circular output aperture 70, thus forming a smooth tapered rectangular to circular transition between the output end 18 of the waveguide 12 and the output aperture 70 of the feed horn 35. The circular output aperture 70 is preferably located at the focus of a reflector (not shown in FIG. 3), so that waves exiting the feed horn 35 through the circular aperture 70 are directed toward the reflecting surface of the reflector and reflected into space in the form of plane waves.

Figure 4:
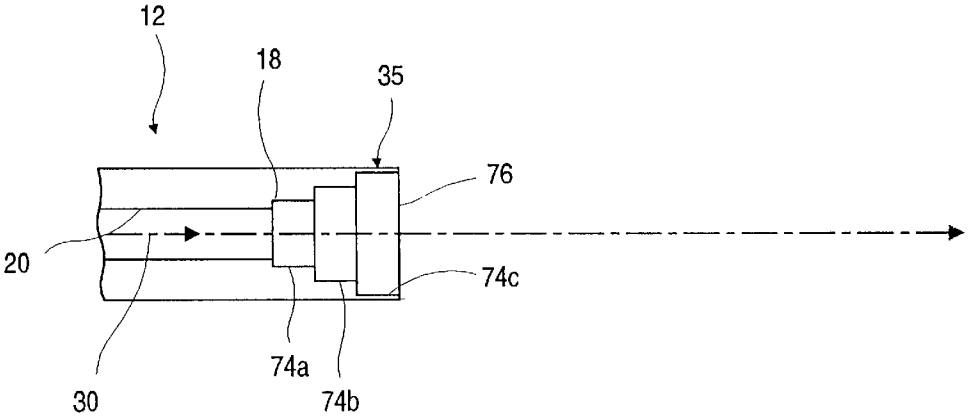
FIG. 4 is a sectional view of another feed horn for use in the feed structure of FIG. 1*a.*

Referring now to FIG. 4, there is illustrated a feed horn 35 according to another embodiment of the present invention. Again, while the following description will refer to operation of the feed horn 35 in a transmission mode for delivering microwave energy to a reflector, it should be understood that the feed horn 35 may also be operated in a receive mode for receiving microwave energy from a reflector. As waves propagate in the direction of arrows 30 and reach the output end 18 of waveguide 12, they encounter a series of outwardly expanding steps 74*a*, 74*b* and 74*c*, each having a progressively increasing cross sectional area. The output aperture 76 at the end of the series of steps 74*a*, 74*b* and 74*c* has a circular cross section adapted to be placed at the focus of a reflector substantially as described above. The number of steps 74 may be varied as needed to provide an efficient stepped transition between the rectangular inner surface 20 of waveguide 12 and the circular output aperture 76.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A microwave antenna comprising:

a reflector;

an antenna feed structure, said feed structure including a waveguide having a first end and a second end, said first end being attached to said reflector, said waveguide having at least one bend along its length, and having a continuous inner surface, said inner surface being generally rectangular in cross section and said waveguide having a continuous outer surface, said outer surface being generally circular in cross section, both said inner generally rectangular-in-cross-section surface and said outer generally circular-in-cross-section surface extending at least along said bend; and a feed horn connected to said second end of said waveguide.

2. The microwave antenna of claim 1 wherein said outer surface of said waveguide includes at least one locating surface for determining an orientation of said waveguide and is shaped to enable said waveguide to be bent in a manner which minimizes deformation of said inner surface of said waveguide.

3. A microwave antenna comprising:

a reflector; and an antenna feed structure attached to said reflector, said feed structure including a waveguide having an inner surface which is generally rectangular in cross section and an outer surface which is generally circular in cross section, said outer surface of said waveguide including at least one locating surface for determining an orientation of said waveguide and being shaped to enable said waveguide to be bent in a manner which minimizes deformation of said inner surface of said waveguide, said outer surface of said waveguide having a cross section including two opposing convex surfaces separated by two opposing flat locating surfaces, and said inner surface of said waveguide having a cross section defining a pair of parallel short legs intersecting a pair of parallel longer legs at four corners, said locating surfaces being parallel to one of said pair of short legs and said pair of longer legs.

4. The microwave antenna of claim 3 wherein said waveguide has a wall thickness defined by the distance between said outer surface of said waveguide and said inner surface of said waveguide, said wall thickness being less about said corners than about said legs of said inner surface.

5. The microwave antenna of claim 1 wherein said feed horn has a circular output aperture positioned approximately at a focus of said reflector and directed toward a reflecting surface of said reflector.

6. The microwave antenna of claim 1 further comprising a hub fastened to said reflector, said hub including a threaded bore and said waveguide including an input end having a threaded cylindrical surface threadedly engaged to said hub.

7. The microwave antenna of claim 6 wherein said waveguide and said hub are composed of aluminum.

8. A microwave antenna comprising:

a reflector; and an antenna feed structure, said feed structure including a waveguide, said waveguide having a reflector end attached to said reflector and a feed horn end, said waveguide having an inner surface generally rectangular in cross section and having an outer surface substantially uniform in outer circumference along the length of the waveguide and generally circular in cross section and a feed horn defined by said outer surface of said waveguide, and by an inside surface, said inside surface connected to said inner surface, said inside surface gradually increasing in size toward the feed horn end to define an output aperture, said aperture being within said outer surface and being positioned approximately at a focus of said reflector and directed toward a reflecting surface of said reflector.

9. The microwave antenna of claim 8 wherein said feed horn has an inner surface defining a smooth tapered rectangular to circular transition.

10. The microwave antenna of claim 8 wherein said feed horn has an inner surface defining a stepped rectangular to circular transition.

11. The microwave antenna of claim 8 wherein said waveguide and said feed horn are composed of aluminum.

12. A feed structure for a reflector comprising:

a metal waveguide having a reflector end and a feed horn end, said waveguide having a continuous inner surface, said inner surface being generally rectangular in cross section and extending along the length of the waveguide and an outer surface, said outer surface being generally circular in cross section and extending along the length of the waveguide, said outer surface having a substantially uniform diameter along the length of said waveguide; and a feed horn integrally formed as a unitary part of an output end of said waveguide within said outer surface.

13. The feed structure of claim 12 wherein said outer surface of said waveguide includes at least one locating surface for determining an orientation of said waveguide and is shaped to enable said waveguide to be bent in a manner which minimizes deformation of said inner surface of said waveguide.

14. A feed structure for a reflector comprising:

a metal waveguide having an inner surface which is generally rectangular in cross section and an outer surface which is generally circular in cross section, the outer surface of said waveguide including at least one locating surface for determining an orientation of said waveguide and being shaped to enable said waveguide to be bent in a manner which minimizes deformation of said inner surface of said waveguide, said outer surface of said waveguide having a cross section including two opposing convex surfaces separated by two opposing flat locating surfaces, and said inner surface of said waveguide having a cross section defining a pair of parallel short legs intersecting a pair of parallel longer legs at four corners, said locating surfaces being parallel to one of said pair of short legs and pair of longer legs; and a feed horn integral with an output end of said waveguide.

15. The feed structure of claim 14 wherein said waveguide has a wall thickness defined by the distance between said outer surface of said waveguide and said inner surface of said waveguide, said wall thickness being less about said corners than about said legs of said inner surface.

16. The feed structure of claim 12 wherein said feed horn has a circular output aperture adapted to be positioned approximately at a focus of a reflector connected to said feed structure and directed toward a reflecting surface of said reflector.

17. The feed structure of claim 12 further comprising a hub threadedly engaged to an input end of said waveguide, said hub including a threaded bore and said input end of said waveguide having a threaded cylindrical exterior surface.

18. The feed structure of claim 12 wherein said feed horn has an inner surface defining a smooth tapered rectangular to circular transition.

19. The feed structure of claim 12 wherein said feed horn has an inner surface defining a stepped rectangular to circular transition.

20. The feed structure of claim 12 wherein said waveguide and said feed horn are composed of aluminum.

21. The feed structure of claim 17 wherein said waveguide and said hub are composed of aluminum.

22. A method of manufacturing a unitary antenna feed structure, including a feed horn, for a reflector having a reflecting surface, said method comprising the steps of:

forming a metal waveguide having an inner surface which is generally rectangular in cross section along its entire length and an outer surface which is generally circular in cross section along its entire length;

forming an input end section in said metal waveguide for attachment to said reflector;

forming a feed horn in an output end section of said waveguide by machining said inner surface to define a rectangular to circular transition zone; and bending said metal waveguide into a curved shape such that said feed horn is directed toward the reflecting surface of said reflector.

* * * * *